US009453433B2

(12) United States Patent
Mohan

(10) Patent No.: US 9,453,433 B2
(45) Date of Patent: Sep. 27, 2016

(54) SYSTEMS AND METHODS FOR REDUCING PARASITIC LOSSES IN CLOSED LOOP SYSTEMS

(71) Applicant: Sankar K. Mohan, Jamesville, NY (US)

(72) Inventor: Sankar K. Mohan, Jamesville, NY (US)

( * ) Notice: Subject to any disclaimer, the term of this patent is extended or adjusted under 35 U.S.C. 154(b) by 231 days.

(21) Appl. No.: 14/310,856

(22) Filed: Jun. 20, 2014

(65) Prior Publication Data

US 2014/0373545 A1 Dec. 25, 2014

Related U.S. Application Data

(60) Provisional application No. 61/837,989, filed on Jun. 21, 2013.

(51) Int. Cl.

| | |
|---|---|
| ***F01K 7/16*** | (2006.01) |
| ***F01K 21/00*** | (2006.01) |
| ***F01K 7/20*** | (2006.01) |
| ***F01K 17/04*** | (2006.01) |
| ***F01K 17/06*** | (2006.01) |

(52) U.S. Cl.

CPC ..... *F01K 7/165* (2013.01); *F01K 7/16* (2013.01); *F01K 7/20* (2013.01); *F01K 17/04* (2013.01); *F01K 17/06* (2013.01); *F01K 21/00* (2013.01)

(58) Field of Classification Search

CPC ..... F01K 7/165; F01K 21/00; F01K 17/06; F01K 17/04; F01K 7/20; F01K 7/16

USPC ..... 60/660, 670

See application file for complete search history.

(56) References Cited

U.S. PATENT DOCUMENTS

| | | | | |
|---|---|---|---|---|
| 3,788,092 | A * | 1/1974 | Miller | F01K 27/00 60/641.6 |
| 4,009,587 | A * | 3/1977 | Robinson, Jr. | F25B 1/00 62/116 |
| 4,502,277 | A | 3/1985 | Papastavros | |
| 4,894,984 | A | 1/1990 | Papastavros | |
| 4,962,645 | A | 10/1990 | Morgan | |
| 5,431,016 | A | 7/1995 | Simpkin | |
| 6,672,064 | B2 | 1/2004 | Lawheed | |
| 8,474,260 | B2 | 7/2013 | Borissov et al. | |
| 8,490,397 | B2 | 7/2013 | Lehar | |
| 2004/0144093 | A1* | 7/2004 | Hanna | F01K 17/02 60/651 |
| 2009/0211253 | A1* | 8/2009 | Radcliff | F01K 23/065 60/670 |
| 2011/0041502 | A1 | 2/2011 | Zimron et al. | |
| 2011/0214625 | A1* | 9/2011 | Nickl | F01K 3/20 123/2 |
| 2012/0244017 | A1 | 9/2012 | Lin | |
| 2013/0174552 | A1 | 7/2013 | Mahmoud et al. | |

* cited by examiner

*Primary Examiner* — Hoang Nguyen

(74) *Attorney, Agent, or Firm* — Paul Frank + Collins P.C.

(57) ABSTRACT

Embodiments of a system that configured as a closed loop system, with a pump, an evaporator, a power generator, and a condenser, the combination of which circulate a working fluid to generate electrical power. The embodiments can harvest residual energy in the working fluid to improve efficiency and to reduce power loss that can derive from the pump as well as other auxiliary loads (e.g., fans). In one embodiment, the system incorporates members that operate in response to the working fluid, often in the higher pressure vapor form that occurs after evaporation and/or power generation stages. These members can include mechanical elements, for example, that have motive action (e.g., reciprocate, rotate, etc.) that is useful to satisfy operating and power requirements of auxiliary loads. For the pressurization stage, these mechanical elements may embody a piston-and-cylinder arrangement (or other rotary or linear positive displacement arrangement) that generates motion that can drive the pump.

24 Claims, 5 Drawing Sheets

SYSTEMS AND METHODS FOR REDUCING PARASITIC LOSSES IN CLOSED LOOP SYSTEMS

CROSS-REFERENCE TO RELATED APPLICATIONS

This application claims the benefit of priority to U.S. Provisional Patent Application Ser. No. 61/837,989, filed on Jun. 21, 2013, and entitled "Systems and methods for Reducing Parasitic Losses in Closed Loop Systems." The content of this provisional application is incorporated herein in its entirety.

BACKGROUND

The present disclosure describes subject matter that relates to closed loop systems that circulate a working fluid, with particular discussion about embodiments of a system that can utilize working fluids to operate one or more components (e.g., a pump) to improve efficiency and/or reduce parasitic losses.

Systems that generate power include closed loop systems that operate under principles of a Rankine Thermodynamic Cycle. These systems use thermal energy from a thermal source fluid to evaporate a working fluid, e.g., a low temperature boiling organic fluid. This process generates high pressure vapor. In conventional designs, the system directs the vapor to a turbine, or like device, that can operate a generator to generate electric power. The system can also cool and condense the vapor to liquid form. During operation, the system circulates the working fluid, in liquid form, for use in the evaporation and power generating stages of the design.

FIG. 1 illustrates a schematic diagram of an example of a conventional closed loop system 100. This embodiment includes a pump component 102, an evaporator component 104 (that utilizes a source fluid S), a power generating component 106, and a condenser component 108 (that utilizes a cooling medium C). The system 100 also includes a fluid circuit 110, typically a construction of fluid conduits (e.g., pipes, tubes, valves, etc.) that couple the components 102, 104, 106, 108 together. The fluid circuit 110 allows a working fluid F to circulate among the components 102, 104, 106, 108. In the example of FIG. 1, the working fluid F exhibits one or more set of working properties (e.g., a first set 112, a second set 114, a third set 116, and a fourth set 118), each set being configured to identify, for example, a pressure and a temperature of the working fluid F that circulates through the fluid circuit 110. The value of the working properties often correspond to phases (e.g., liquid, vapor, etc.) of the working fluid F.

For most closed loop designs, the system 100 is configured to continuously circulate the working fluid among the various stages (i.e. evaporation, power generation, and condensation). These configurations often employ a pump (e.g., pump component 102) that pressurizes the working fluid, in liquid form, prior to delivery to the evaporation and/or power generation stages. In many cases, the system will supply power to drive the pump from the generator. This feature, however, reduces the power from the system that would otherwise be available for use.

BRIEF DESCRIPTION OF THE INVENTION

The present disclosure contemplates improvements that configure systems to harvest residual energy in the thermal source fluid to improve efficiency and to reduce power loss that can derive from the pump as well as other auxiliary loads (e.g., fans). The principles of operation of these systems can enjoy wide application, particularly with respect to closed loop (or hermetically sealed systems) that might, for example, utilize positive displacement machines instead of turbines. As noted herein, these systems can incorporate members that operate in response to the working fluid, often in vapor form and/or at higher pressure consistent with working fluid after evaporation and/or power generation stages. Examples of the working fluid can include refrigerants (e.g., R245fa), although this disclosure contemplates other fluids (and components) that can operate in closed-loop (and/or hermetically sealed) systems. The members can include mechanical elements, for example, that have motive action (e.g., reciprocate, rotate, etc.) that is useful to satisfy operating and power requirements of the auxiliary loads. For the pressurization stage, these mechanical elements may embody a piston-and-cylinder arrangement (or other positive displacement arrangement) that generates motion that can drive a pump.

Embodiments of the systems below enjoy a variety of operating advantages over conventional designs. For example, the improvements can eliminate the need to siphon power from the generator or to dedicate an external power source, both of which may be necessary in conventional systems to operate the pump to circulate the working fluid at appropriate pressures. In one implementation, assuming a nominal 10% efficiency for energy transformation, the electrical power to drive the pump in conventional designs may be ten (10) times more expensive than the thermal energy that the embodiments can be recouped by utilizing the working fluid as set forth herein. Moreover, because the system is configured so that the mechanical elements and the auxiliary load (e.g., the pump) utilize the same working fluid, the design of the embodiments below can tolerate internal leaks and enjoy wider, less stringent dimensional tolerances for these components. Any loss in volumetric efficiency is offset by the availability of "free" energy that the system recuperates, rather than discards as found in conventional designs. This feature can allow the system to incorporate mechanical elements that are favorably designed, e.g., with less attention to tight seals. The resulting designs can improve mechanical advantage, reduce friction, and, notably, further enhance the overall efficiency of the system.

BRIEF DESCRIPTION OF THE DRAWINGS

Reference is now made briefly to the accompanying Appendix in which.

Where applicable like reference characters designate identical or corresponding components and units throughout the several views, which are not to scale unless otherwise indicated.

DETAILED DISCUSSION

This discussion below describes embodiments of systems (e.g., closed loop systems) that are configured to utilize the working fluid F to operate one or more of the components and devices found therein. The components and devices may include fans and pumps that are necessary for the system to operate, e.g., to circulate the working fluid F at the appropriate working properties. In conventional designs, the devices represent parasitic losses that consume some amount of power, often power that the system generates during operation. Improvements to closed loop systems based on aspects of the present disclosure, on the other hand, can eliminate certain parasitic losses to maintain, and effectively improve, overall efficiency as compared to these conventional systems.

Figure 1:
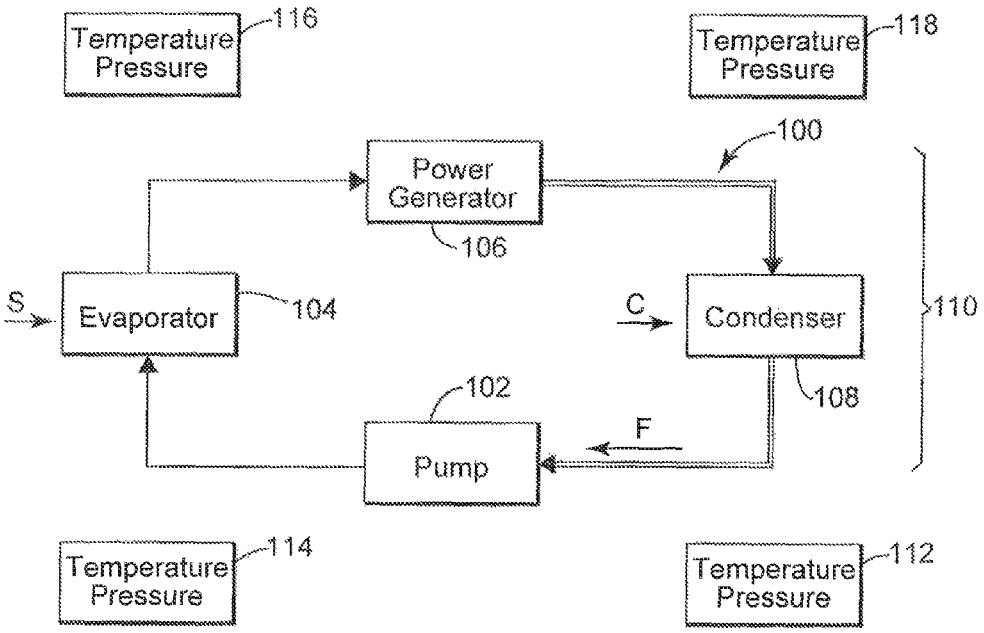
Fig. 1 Prior Art
FIG. 1 depicts a schematic diagram of an exemplary embodiment of a conventional closed loop system.
Figure 2:
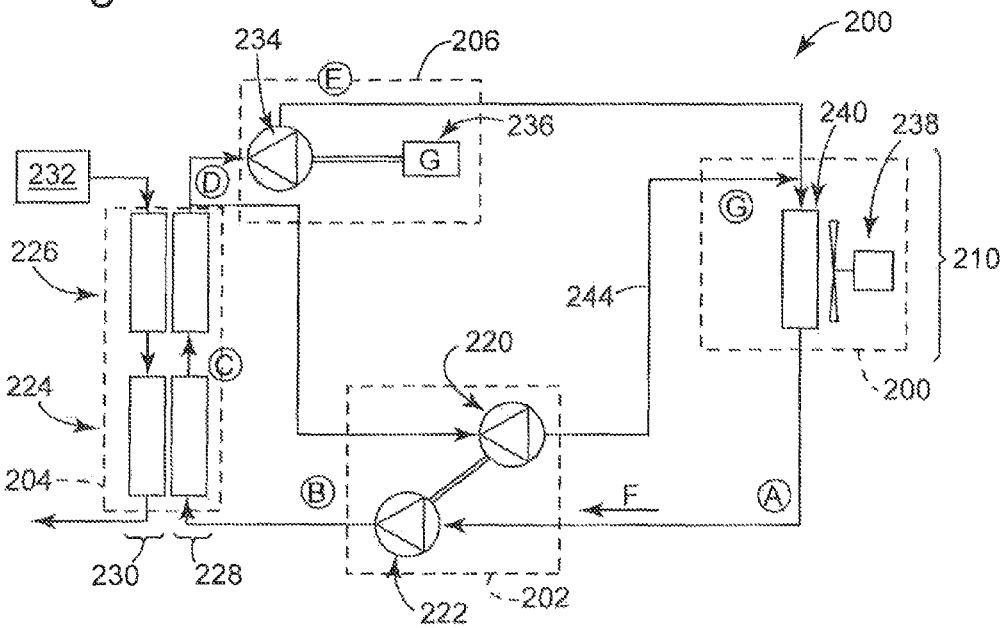
FIG. 2 depicts a schematic diagram of an exemplary embodiment of a closed loop system in a configuration that can utilize working fluid from the main evaporator to drive mechanical elements to operate, e.g., a pump.
Figure 3:
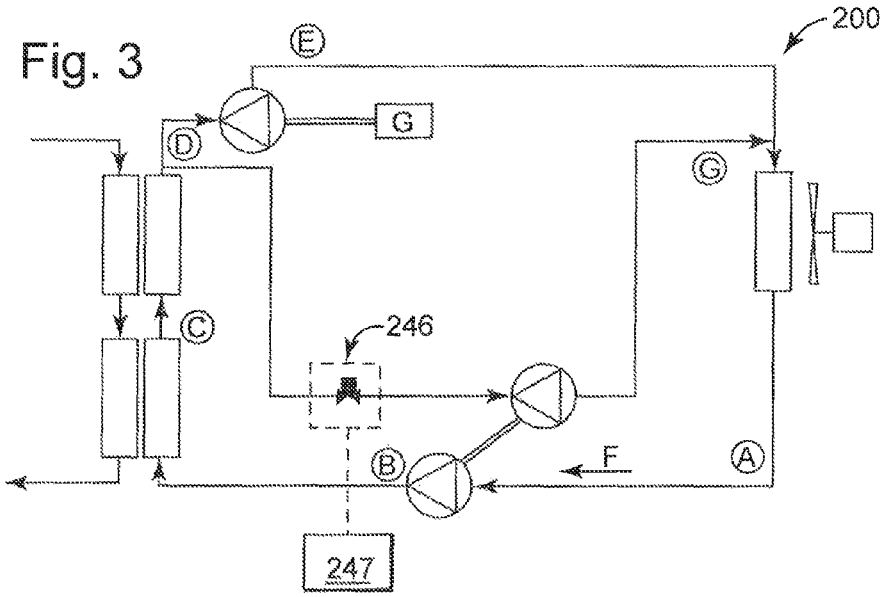
FIG. 3 depicts the system of FIG. 2 with a control element to regulate flow of working fluid to the mechanical elements.

FIGS. 2 and 3 illustrates a schematic diagram of an exemplary embodiment of a system 200 in a configuration that can address certain parasitic losses. The pump component 202 includes a drive member 220 that couples with a pump member 222. The evaporator member 204 can include a heater member 224 and an evaporator member 226, each having a circuit portion 228 and a heated portion 230 that couples with a heat source 232. The power generating component 206 has a turbine member 234 that couples with a generator member 236. The combination of the components 234, 236 can generate electric power during operation of the system 200. The condenser component 208 can include a fan member 238 that operates to cool a condenser member 240. The fluid circuit 210 can include one or more fluid paths (e.g., a first fluid path 242 and a second fluid path 244) that couple one or more of the components and members of the system 200 together. As best shown in FIG. 3, the system 100 can also include one or more control components (e.g., a first control component 246) that couple with a control system 247. Examples of the control components can include valves, pumps, sensors, and like devices that operate, for example as instructed by the control system 247, to regulate, inter alia, the flow of the working fluid about the fluid circuit 210.

During operation, the system 200 leverages changes in the working properties and phases of the working fluid F to convert thermal energy to mechanical and/or electrical energy. Starting in the lower right corner of FIG. 2, and working clock-wise around the system 200, the working fluid F enters the pump component 202 at a first pressure (e.g., 2 bar) and a first temperature (e.g., 40° C.). The pump component 202 changes the first pressure to a second pressure (e.g., 20 bar) that is different (e.g., greater) than the first pressure. The evaporator component 204 is configured to modify the temperature of the working fluid F from the first temperature to a second temperature (e.g., 125° C.) that is different (e.g., greater) than the first temperature. The power generating component 206 extracts useful work (e.g., to turn a turbine) from the working fluid F, which in turn changes the temperature of the working fluid F from the second temperature to a third temperature (e.g., 80° C.) that is different (e.g., less) than the second temperature and changes the second pressure to a third pressure (e.g., 2 bar) that is different (e.g., less) than the second pressure. From there, the condenser component 102 is configured to modify the temperature and pressure of the working fluid F, typically back to the first temperature and the first pressure.

Construction of the system 200 utilizes the working fluid F to drive the pump component 202. For example, the drive member 220 can embody one or more devices (e.g., a piston and cylinder, a diaphragm, an impeller, etc.) that move in response to flow of the working fluid F. This motive action can, in turn, drive the pump member 222 to elevate the pressure (e.g., from the first pressure to the second pressure) of the working fluid F. As shown in FIGS. 2 and 3, the working fluid F can circulate to the drive member 220 via the second fluid path 244, which couples with the first fluid path 242 at one or more points, for example, at a first point downstream of the turbine member 234 and/or upstream of the condenser member 240 and at a second point upstream of the turbine member 234 and downstream of the heater member 224. This configuration provides the drive member 220 with the working fluid F in it vapor phase, typically with working properties that correspond to the working fluid F that exits the heater member 224.

As noted above, the design of the system 200 can accommodate different configurations for the drive member 220. These different configurations are useful to tailor one or more mechanical elements (e.g., a piston) in the drive member 220 and/or the pump member 222 to allow the pump component 202 to deliver the working fluid F at sufficient discharge pressure (e.g., the second pressure) and/or volume flow rate. This feature can compensate for variations in pressure of the working fluid F that is available to operate the drive member 220. At a high level, the drive member 220 and the pump member 222 can have, respectively, a first operative dimension and a second operative dimension. Examples of the operative dimensions can define dimensions (e.g., a diameter) of mechanical elements (e.g., a piston) and/or other parts of the member(s) that interface with the working fluid F or otherwise relate to operation of the pump component 202 to pressurize the working fluid. In one example, the first operative dimension can have a first value and the second operative dimension can have a second value, wherein the first value is proportional to the second value to configure the drive member to operate the pump member to pressurize the working fluid in liquid phase in response to the working fluid in vapor phase at a third pressure that is less than the second pressure. For implementations that use reciprocating piston-type elements, this feature can configure the drive piston to be made proportionately larger that the pump member to operate at lower pressures but still achieve sufficient mechanical advantage to move the pump member to pressurize the working fluid F, e.g., from the first pressure to the second pressure (discussed above). In one example, considering a working pressure of 20 bar, and a heat source of only 70° C. (corresponding to approximately 5 bar available pressure), the drive piston would need to be four (4) times the area of the pump piston. Any considerations for lowered system efficiency are not a concern because the source of thermal energy is effectively "free." Moreover, embodiments of the system 200 can avoid inefficiencies inherent in the electric generator and, for example, an electric drive motor of the pump, by directly using the working fluid to drive the pump member 222.

Figure 4:
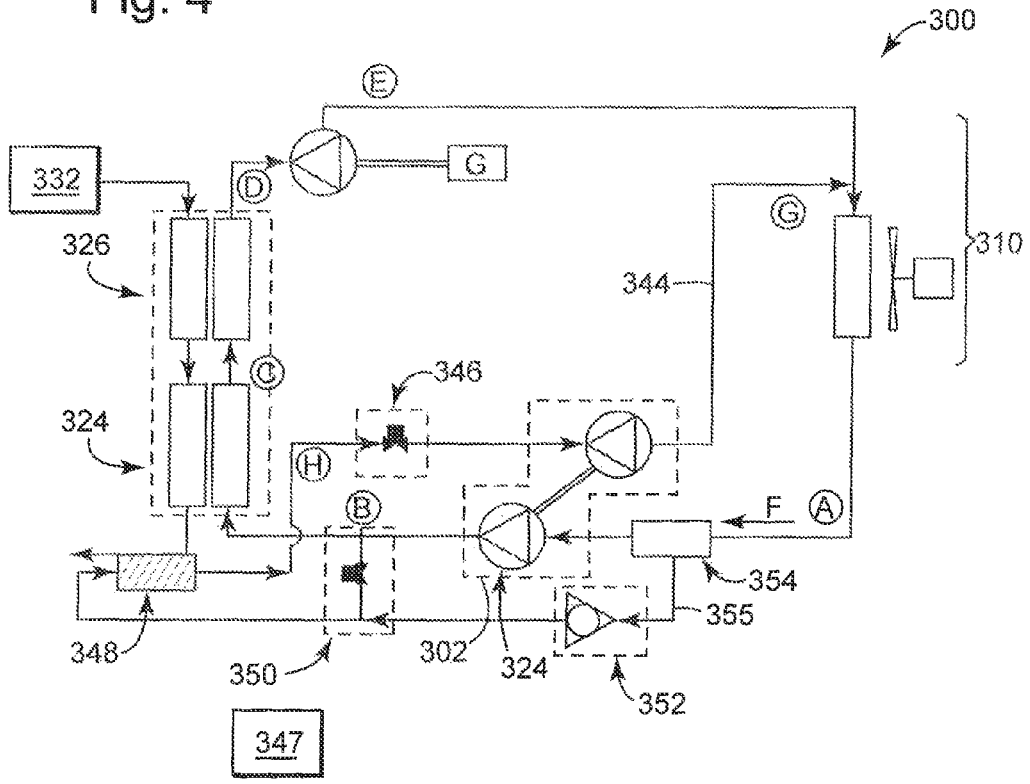
FIG. 4 depicts a schematic diagram of an exemplary embodiment of a closed loop system in a configuration that can utilize working fluid from an auxiliary heat recovery unit to drive mechanical elements to operate, e.g., a pump.
Figure 5:
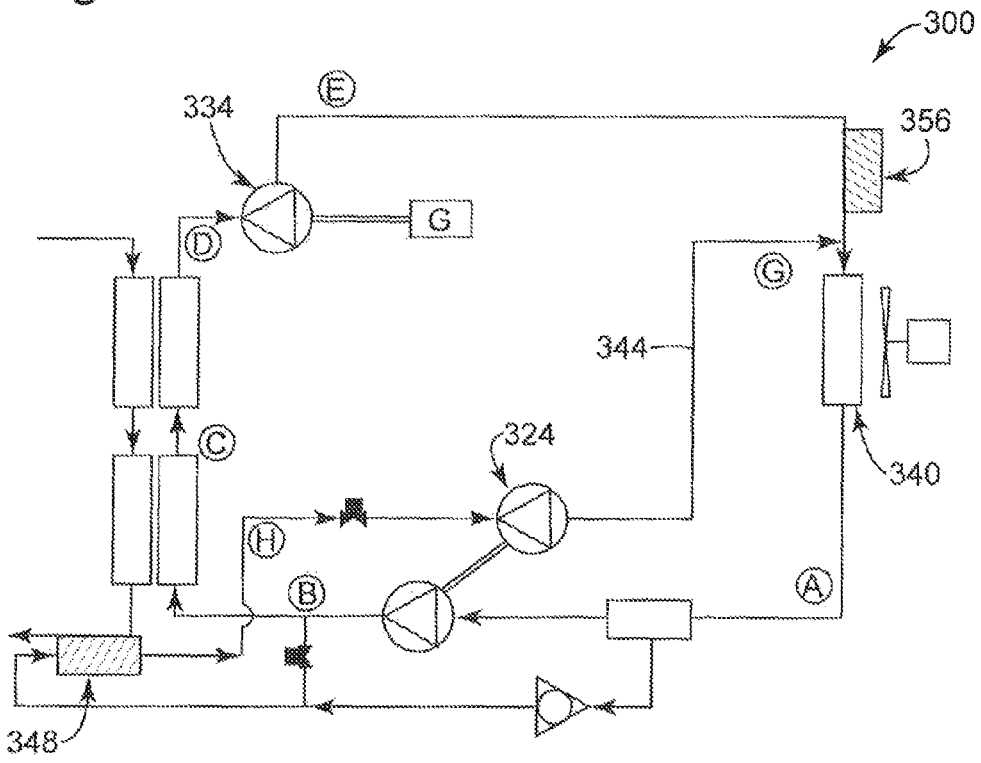
FIG. 5 depicts the system of FIG. 4 with additional components that can facilitate operation of the system to drive the mechanical elements.
Figure 6:
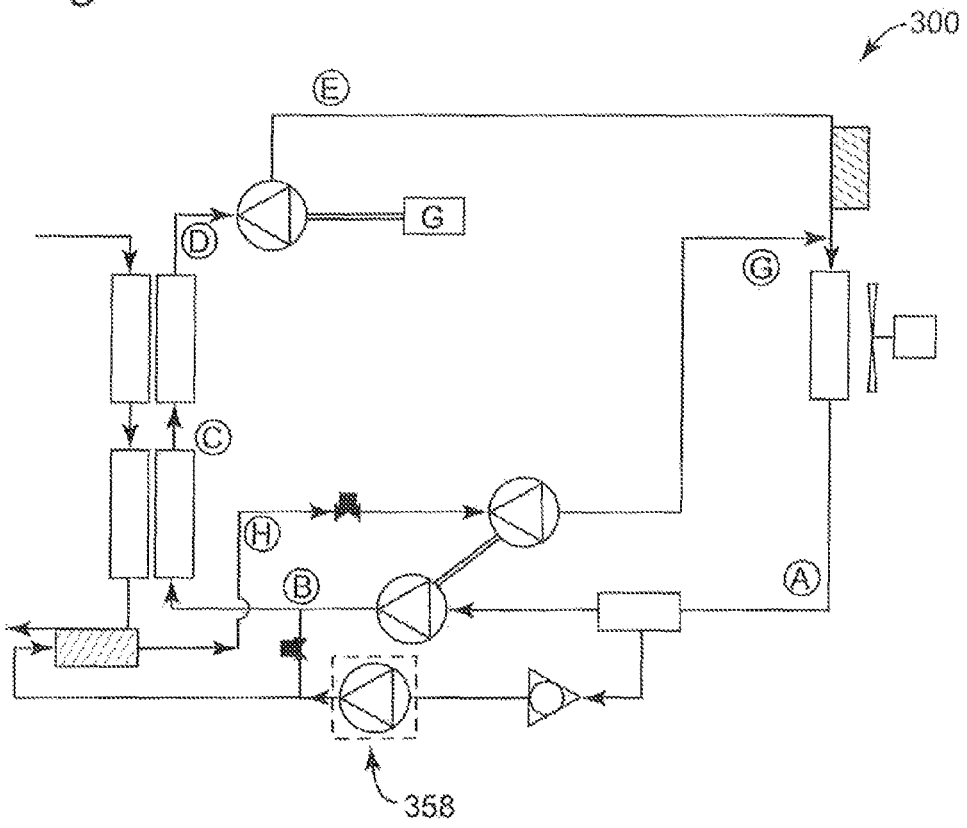
FIG. 6 depicts the system of FIG. 4 with additional components that can facilitate operation of the system to drive the mechanical elements.

FIGS. 4, 5, and 6 depict schematic diagrams of an exemplary embodiment of a system 300 in a configuration that can also further reduce parasitic losses. In FIG. 4, the system 300 includes one or more heat recovery units (e.g., a first heat recovery unit 348). The system 300 can also include a second control component 350 and a third control component 352. In one embodiment, the system 300 can also include a reservoir member 354 that is configured to retain a volume of the working fluid F therein. The system 300 can also includes a third flow path 355, which couples the heat recovery unit 348 with the reservoir member 354. This configuration can allow working fluid to flow from the volume of the reservoir member 354 to prime the heat recovery unit 348 to flow of the working fluid F at start-up of the system 300.

The system 300 recovers thermal energy of a source fluid from the heat source 332. This source fluid is useful to evaporate the working fluid, e.g., in the evaporator component 304. Notably, the need for high efficiency in, e.g., Organic Rankine Cycle (ORC) systems, requires designers to operate vapor temperatures that are as high as possible. However, thermodynamic "pinch point" and like considerations in the evaporator component 304 can prevent use of all available heat in the source fluid. These limitations causes the source fluid to exit the evaporator component 304 at relatively high temperatures. In one example, the source fluid may enter the evaporator component 304 at a first source temperature (e.g., 150° C.) and exit the evaporator component 304 at a second source temperature (e.g., 120° C.) that is different (e.g., less than) the first source temperature. FIG. 5 depicts the system 300 with a second heat recovery unit 356, which can be used in addition to, or in lieu of, the first heat recovery unit 348. As best shown in FIG. 6, the system 300 may also include a fourth control component 358, in this case a pump device that can also operate during start-up and initial operation of the system 100.

The system 300 can recover the thermal energy at the second source temperature to provide working fluid F in vapor form to the drive member 322. For example, as shown in FIG. 4, the first heat recovery unit 348 couples downstream of the evaporator component 304 to receive the source fluid at the second source temperature. The heat recovery unit 348 also couples downstream of the pump component 302 to receive the working fluid F and, in one construction, transfers thermal energy in the source fluid to the working fluid F to modify the working properties. In one example, the working fluid F exits the heat recovery unit 348 in vapor form, which in turn flows to the drive member 322 to generate useful work to operate the pump member 324.

Use of the second heat recovery unit 356 of FIG. 5 can recover residual thermal energy in the working fluid F that exits the turbine member 334. Generally, the exit temperature of the working fluid F from the turbine member 334 depends on the thermodynamics of the turbine operations. This exit temperature is, however, typically higher than the temperature at which the working fluid F condenses to liquid form. In one embodiment, the second heat recovery unit 356 can couple downstream of the turbine member 334 and upstream of the condenser member 340. This configuration can utilize the thermal energy in the working fluid F downstream of the turbine member 334, for example, to provide fluid, via a fourth flow path (not shown), having working properties sufficient to generate useful work to operate the pump member 324.

At start-up, the system 300 can utilize several of the peripheral components found in FIGS. 4, 5, and 6. In one implementation, and prior to start-up, working fluid F in the condenser member 340 may drain (e.g., by gravity) into the reservoir member 354. The third flow control 352 (e.g., a check valve) is configured to move between a first check position and a second check position, wherein prior to start-up the third flow control 352 allows fluid from the reservoir member 354 to flow, e.g., via the third flow path 355, to the first heat recovery unit 348. This feature primes the first heat recovery unit 348 with working fluid F sufficient to "boil" when operation of the system 300 is initiated. During operation, and as pressure rises, the third flow control 352 will change position to prevent fluid flow from the reservoir member 354 to the first heat recovery unit 348, e.g., via the third flow path 355. Further, the control system 347 can operate the first control component 346 to allow working fluid F from the first heat recovery unit 348 to flow to the drive member 322. The control system 347 can also operate the second control component 350 to continue to allow working fluid F to flow to the heat recovery unit 348, thereby maintaining the vapor feed to the drive member 322. In one embodiment, when gravity fed priming is not sufficient, the control system 347 can instruct the auxiliary pump (e.g., fourth control component 356 of FIG. 6) to operate to facilitate flow of the working fluid F from the reservoir member 354 to the heat recovery unit 348.

The control system 347 can be configured to manage the process of the system 300. This configuration may require use of one or more processors, memory, and related circuitry that can allow the control system 347 to exchange signals, instructions, etc. with the various components of the system 300. In certain embodiments, the control system 347 may utilize executable instruction or machine readable instructions (e.g., software, firmware, etc.) that the one or more processors are configured to execute in order to perform, e.g., processing and generating of signals.

In light of the foregoing discussion, the embodiments contemplated herein use motive device(s) that can replace, for example, electric motors typical of conventional closed-loop ORC systems. These electric motors require electric power from the generator or from a power supply separate from the overall system. On the other hand, in lieu of using such external power, the embodiments can recycle and/or recuperate energy inherent in the overall design of the closed loop ORC design. This feature offers a net gain in efficiency of these embodiments by effectively removing losses related to use of electrical power to drive the pump or other electrical loads. Moreover, configurations of the embodiments that utilize the working fluid F to operate certain mechanical elements often do not require vapor-tight and/or hermetic seals. Because the working fluid is the same as the pumped fluid, small internal leaks are not critical and can be tolerated. These configurations can maintain appropriate volumetric efficiencies with looser tolerances that allow for small leaks and/or otherwise eliminate the need to seal the system from the surrounding environment. Designs and constructions with looser tolerances, in turn, reduce internal friction and improve mechanical efficiencies.

As used herein, an element or function recited in the singular and proceeded with the word "a" or "an" should be understood as not excluding plural said elements or functions, unless such exclusion is explicitly recited. Furthermore, references to "one embodiment" of the claimed invention should not be interpreted as excluding the existence of additional embodiments that also incorporate the recited features.

This written description uses examples to disclose embodiments of the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A system for generating power, said system comprising:

a closed loop fluid circuit configured to circulate a working fluid to a pump component, an evaporator component, a power generating component, a condenser component, and a heat recovery unit coupled with the evaporator component to receive a thermal source fluid from the evaporator component at a temperature sufficient to evaporate the working fluid, the closed loop fluid circuit comprising a flow path that is configured to direct the working fluid in vapor phase from the heat recovery unit to the pump component, wherein the pump component is configured to pressurize the working fluid in liquid phase in response to flow of the working fluid in vapor phase.

2. The system of claim 1, wherein the pump component comprises a drive member and a pump member, and wherein the drive member is configured to generate a motive action in response to flow of the working fluid in vapor phase to cause the pump member to operate to pressurize the working fluid in liquid phase from a first pressure to a second pressure that is greater than the first pressure.

3. The system of claim 2, wherein the drive member and the pump member have, respectively, a first operative dimension and a second operative dimension, wherein the first operative dimension has a first value and the second operative dimension has a second value, and wherein the first value is proportional to the second value to configure the drive member to operate the pump member to pressurize the working fluid in liquid phase in response to flow of the working fluid in vapor phase at a third pressure that is less than the second pressure.

4. The system of claim 1, wherein the flow path couples at a first point in the fluid circuit that is downstream of the evaporator component and upstream of the power generating component.

5. The system of claim 4, wherein the flow path couples at a second point in the fluid circuit that is downstream of the power generating component and upstream of the condenser component.

6. The system of claim 1, wherein the flow path couples with a first the heat recovery unit upstream of the pump component, and wherein the heat recovery unit is configured to transfer thermal energy from a thermal source fluid to the working fluid in liquid phase, wherein the thermal source fluid is different from the working fluid.

7. The system of claim 6, wherein the first heat recovery unit is configured to receive the thermal source fluid downstream of the evaporator component.

8. The system of claim 6, further comprising a reservoir member coupled with the fluid circuit downstream of the condenser component, wherein the reservoir member is configured to retain a volume of the working fluid in liquid phase.

9. The system of claim 8, further comprising a flow control component coupled downstream of the reservoir member and upstream of the first heat recovery unit, wherein the flow control component is configured to regulate flow of the working fluid from the reservoir member to the heat recovery unit.

10. A system for generating power, said system comprising:

a first flow path that is configured to circulate a working fluid between an evaporator component, a power generating component, an evaporator component, and a pump component; and a second flow path that couples with the first flow path to direct the working fluid in vapor phase to a mechanical element that is configured for motive action in response to the working fluid in vapor phase, wherein the second flow path includes a heat recovery unit that is coupled with the evaporator component to receive a thermal source fluid from the evaporator component at a temperature sufficient to evaporate the working fluid.

11. The system of claim 10, wherein the second flow path couples with the first flow path at a first point downstream of the evaporator component.

12. The system of claim 10, wherein the mechanical element couples with a pump component that is configured to pressurize the working fluid in the first flow path in response to the motive action.

13. The system of claim 12, wherein pump component has a pump member that interfaces with the working fluid in liquid phase, wherein the mechanical element and the pump member have, respectively, a first operative dimension and a second operative dimension, wherein the first operative dimension has a first value and the second operative dimension has a second value, and wherein the first value is proportional to the second value to configure the drive member to operate the pump member to pressurize the working fluid in liquid phase from a first pressure to a second pressure, which is larger than the first pressure, in response to the working fluid in vapor phase at a third pressure that is less than the second pressure.

14. The system of claim 10, further comprising:

a reservoir member coupled with the first flow path downstream of the condenser component, the reservoir member configured to retain a volume of the working fluid in liquid phase; and a third flow path coupled with the reservoir member and with the heat recovery unit, wherein the third flow path is configured to regulate flow of working fluid in liquid phase from the reservoir member to the heat recovery unit.

15. The system of claim 14, further comprising a check valve coupled with the third flow path downstream of the reservoir member and upstream of the heat recovery unit, wherein the check valve is configured to change position to allow and prevent flow of working fluid in liquid phase to the heat recovery unit.

16. A closed loop system with a fluid circuit configured to circulate a working fluid, said closed loop system comprising:

an evaporator component;

a heat recovery unit coupled with the evaporator component to receive a thermal source fluid from the evaporator component at a temperature sufficient to evaporate a working fluid from liquid phase to vapor phase;

a flow path that is configured to couple with the fluid circuit to divert the working fluid to the heat recovery unit in liquid phase from the fluid circuit; and a pump component that is configured to couple with the flow path, the pump component comprising a drive member and a pump member, the drive member comprising a mechanical element that is configured for motive action in response to the working fluid in vapor phase from the heat recovery unit to operate the pump member to pressurize the working fluid.

17. The closed loop system of claim 16, further comprising a reservoir member that is configured to couple with the fluid circuit to receive the working fluid in liquid phase, wherein said system is further configured to couple the reservoir member and the heat recovery unit to allow the working fluid in liquid phase to flow from the reservoir member to the heat recovery unit.

18. The closed loop system of claim 16, wherein the motive action is configured for reciprocating movement.

19. The closed loop system of claim 16, wherein the motive action is configured for rotary movement.

20. The closed loop system of claim 16, wherein the mechanical element and the pump member have, respectively, a first operative dimension and a second operative dimension, wherein the first operative dimension has a first value and the second operative dimension has a second value, and wherein the first value is proportional to the second value to configure the drive member to operate the pump member to pressurize the working fluid in liquid phase from a first pressure to a second pressure, which is larger than the first pressure, in response to the working fluid in vapor phase at a third pressure that is less than the second pressure.

21. The closed loop system of claim 20, wherein the first value is proportionally larger than the second value.

22. The system of claim 1, further comprising a second heat recovery unit configured to recover thermal energy from effluent of the power generating component.

23. The system of claim 1, further comprising a second heat recovery unit configured to recover thermal energy from effluent of the power generating component.

24. The system of claim 1, further comprising as power generating component coupled with the evaporator and a second heat recovery unit configured to recover thermal energy from effluent of the power generating component.

* * * * *